US008961847B2

(12) United States Patent
Biçakçi

(10) Patent No.: US 8,961,847 B2
(45) Date of Patent: Feb. 24, 2015

(54) METHOD TO CREATE THREE DIMENSIONAL IMAGE INSIDE STONE

(76) Inventor: Sevan Biçakçi, Istanbul (TR)

( * ) Notice: Subject to any disclaimer, the term of this patent is extended or adjusted under 35 U.S.C. 154(b) by 175 days.

(21) Appl. No.: 13/386,556

(22) PCT Filed: Dec. 15, 2009

(86) PCT No.: PCT/TR2009/000153

§ 371 (c)(1),
(2), (4) Date: Jan. 23, 2012

(87) PCT Pub. No.: WO2011/010971

PCT Pub. Date: Jan. 27, 2011

(65) Prior Publication Data

US 2012/0118472 A1 May 17, 2012

(30) Foreign Application Priority Data

Jul. 23, 2009 (TR) ..... a 2009 05721

(51) Int. Cl.
*B44C 1/26* (2006.01)
*B44C 3/02* (2006.01)
*B44C 5/00* (2006.01)

(52) U.S. Cl.
CPC . *B44C 1/26* (2013.01); *B44C 3/025* (2013.01); *B44C 5/005* (2013.01)
USPC ..... 264/225

(58) Field of Classification Search
USPC ..... 264/271.1, 279; 63/32
See application file for complete search history.

(56) References Cited

U.S. PATENT DOCUMENTS

| | | | | |
|---|---|---|---|---|
| 4,347,270 | A | 8/1982 | Hart | |
| 4,809,417 | A * | 3/1989 | Normann, Jr. | 29/896.41 |
| 5,599,594 | A * | 2/1997 | Pauley | 428/13 |
| 6,003,228 | A | 12/1999 | Riggio | |

FOREIGN PATENT DOCUMENTS

| | | | |
|---|---|---|---|
| DE | 114760 | C | 1/1900 |
| WO | 9725282 | A1 | 7/1997 |
| WO | 9748565 | A1 | 12/1997 |

OTHER PUBLICATIONS

International Search Report for corresponding International Application No. PCT/TR2009/000153.

* cited by examiner

*Primary Examiner* — Larry Thrower
*Assistant Examiner* — Xue Liu
(74) *Attorney, Agent, or Firm* — Egbert Law Offices, PLLC

(57) ABSTRACT

A method for creation of a three-dimensional image in a transparent stone comprises process steps: of curving the inside of the said transparent stone, forming space therein and providing an outer shell, making at least one designing on the surface of the said outer shell facing inside, making at least one transparent filling layer on the surface of the said outer shell facing inward, making at least one designing on the surface of the said filling layer facing inward, repeating one under the other the designing and filling layer designing as per the design on the surface of the said filling layer facing inward, connecting a at least one three-dimensional object to the inward facing surface of the filling layer at the very bottom, and closing the lower part of the stone.

8 Claims, 3 Drawing Sheets

METHOD TO CREATE THREE DIMENSIONAL IMAGE INSIDE STONE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The invention relates to a method for creation of images inside transparent stones.

The invention particularly relates to a method for creation of various figures in three dimensions in inner parts of precious stones and/or accessories used in jewelry.

2. Description of Related Art Including Information Disclosed Under 37 CFR 1.97 and 37 CFR 1.98

Processing embodiments inside and on various stones have been realized in order to create images from different designs, pictures and figures in inner parts of transparent stones. The said processing is made by means of designs and colouring coating made on the stone in the simplest way. Another embodiment relates to processes conducted inside transparent stones. Processing the inner part of the stone to give an image outside is another applied method. The said method has some problems in terms of application. Cutting the inner part of the stone brings the risk of damaging the stone. There are always risks such as breaking or weakening of the stone during removal of inner part of the stone. Processing the inner part of the stone is not easy by use of modern processing members either. One of the said applications is disclosed under patent application numbered TR200607117 entitled "process for sculpture processing in stone". The said application discloses a process containing curving the inner part of the stone and removal of it by use of special methods and filling the space by filling material after painting thereof. The steps of the process consist of three steps: obtaining a space by means of eroding the lower part of the jewelry stone by use of mechanical method as required by the desired architecture, leaving the eroded and spaced shape as it is in the simple manner or painting in colours by appropriate paint, and filling the space areas of the stone of which painting has been completed, by use of a filling material of hardness close to hardness of the stone.

The said art and applications are for forming a two dimensional image in or on the stone. The known technical applications do not allow to create three dimensional images on or in the stone. Upon development of imaging technologies, capability to create three dimensional images has become an alternative to two dimensional images not having depth. Creating three-dimensional images on or in the stone enables giving an effect much closer to the real effect of accessories and is one of the factors determining the preference of consumer. In order to create three-dimensional image and depth, gradual curving in the stone outward is conducted and thus a three-dimensional image can be created. Although it is not so close to the real appearance, the depth can be provided. Even it is likely to create this image for one single member, when images of objects independent of each other are, the gradual curving remains inadequate.

In order to eliminate the said disadvantages, it is aimed to produce jewelry accessories having three-dimensional images.

BRIEF SUMMARY OF THE INVENTION

From the current status of the related art, the purpose of the invention is to eliminate the existing disadvantages by means of improvements made in manufacturing methods used for creation of various three-dimensional figures in inner parts of the precious stones and/or accessories used particularly in jewelry.

Another purpose of the invention is to disclose a stone processing method for image details of real like image which are connected to the desired part of any jewelry and decorative properties such as ring, bracelet, necklace, ear-rings, brooch and cuff links. A further purpose of the invention is to enhance visual depth. Another purpose of the invention is to provide visual effect of figures, shapes, pictures, designs closer to real.

Another purpose of the invention is to provide complex figures having different details. A further purpose of the invention is to provide coloured and non-coloured images. Thus various alternatives in jewelry have been provided. Therefore, process of figures not intended to be applied in jewelry accessories has been provided. Use of foreign material has been prevented by means of providing design on the stone in this way. Thus, decrease in value of jewelry accessories has been prevented.

In order to achieve the said purposes, it is a method for creation of three-dimensional image in transparent stones used as jewelry and accessories in particularly jewelry and precious stones sector.

A preferred embodiment of the invention is a method for creation of a three dimensional image in the said transparent stone and it comprises process steps of curving the inside of the said transparent stone, forming a space therein and providing an outer shell, making at least one design on the surface of the said outer shell facing inside, making at least one transparent fill layer on the surface of the said outer shell facing inward, making at least one design on the surface of the said filling layer facing inward, repeating one under the other the design and filling layer design as per the design on the surface of the said filling layer facing inward, connecting a at least one three-dimensional object to the inward facing surface of the filling layer at the very bottom, and closing the lower part of the stone.

REFERENCE NUMBERS

Figure 1A:
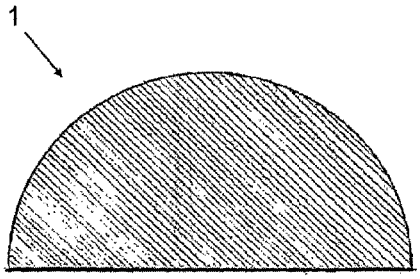
FIG. 1*a* is a general view of an illustrative stone with processed inner side of the stone.
Figure 1B:
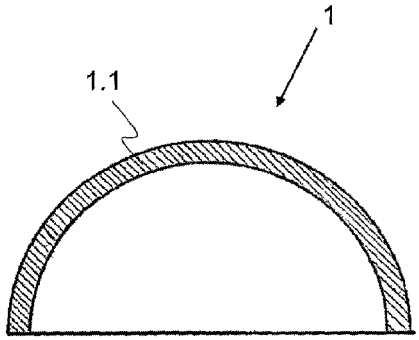
FIG. 1*b* is a section view of the curved form of the stone in the illustrative embodiment shown in FIG. 1*a*.

1 Stone
1.1 Outer shell
2 Filling layer
3 Engraving
4 Relief
5 Three-dimensional object
5.1 Space
5.2 Filling inner figure
5.3 Filling outer figure

DETAILED DESCRIPTION OF THE INVENTION

The application shown in figures of the invention relates to a manufacturing method used for creation of various figures in three dimensions in inner parts of precious stones and/or accessories used in jewelry.

The manufacturing processes of the method to form three-dimensional image inside the transparent stone (1) shown in FIGS. 1*a*, 1*b*, 1*c* and 1*d* are as follows.

The manufacturing process comprises process steps of: curving the inside of the transparent stone (1), forming a space therein and providing an outer shell (1.1), making at least one designing on the surface of the said outer 5 shell (1.1) facing inside, making at least one transparent filling layer (2) on the surface of the said outer shell (1.1) facing inward, making at least one designing on the surface of the said filling layer (2) facing inward, repeating one under the other the designing and filling layer (2) designing as per the design on the surface of the said filling layer (2) facing inward, connecting one three-dimensional object (5) to the inward facing surface of the filling layer (2) at the very bottom, and closing the lower part of the stone (1) to complete the manufacturing. The three-dimensional object (5) applied to inner part of the space (5.1) can be provided in convenient different colours and image designs as per the stone (1).

Figure 1C:
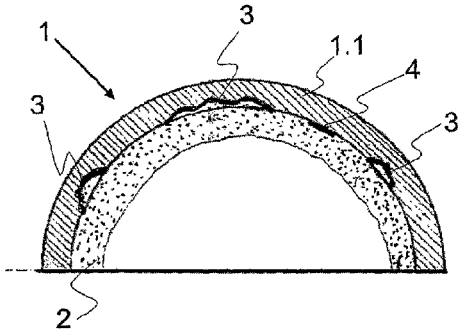
FIG. 1*c* is a section view of the curved form of the stone and covered with a layer in the illustrative embodiment shown in FIG. 1*b*.

The designing process is an engraving (3) formed by means of curving on the inward facing surface of the outer shell (1.1) (FIG. 1*c*). The designing process is a relief (4) formed by means of embossing on the inward facing surface of the outer shell (1.1) (FIG. 1*c*).

The designing process is an engraving (3) formed by means of curving on the inward facing surface of the filling layer (2). The designing process is a relief (4) formed by means of embossing on the inward facing surface of the filling layer (2). Relief (4) is the painting layer forming thickness and colour.

Figure 2A:
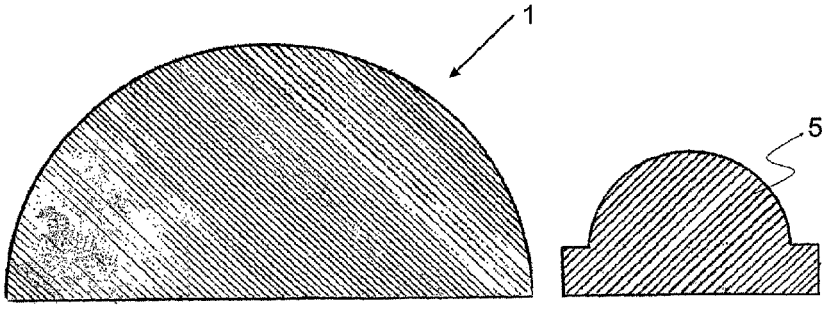
FIG. 2*a* is a general view of the stone and three-dimensional object connected thereto in the illustrative embodiment shown in FIG. 1*a*.
Figure 2B:
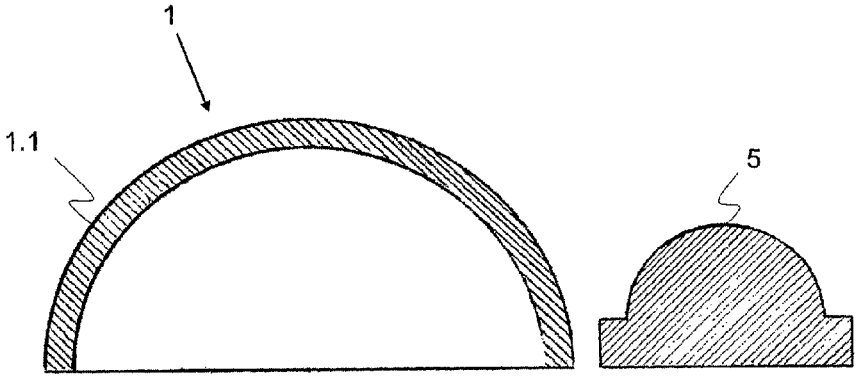
FIG. 2*b* is a sectional view of the stone with space therein and three dimensional object therein in the illustrative embodiment shown in FIG. 1*b*.

FIG. 2*a* and FIG. 2*b* show a different manufacturing method wherein a three dimensional object (5) of three dimensional image has been provided in the stone (1).

The transparent stone (1) shown in FIGS. 2*a*, 2*b*, 2*c* and 2*d*, is formed by curving of the inner side thereof, forming space and leaving an outer shell (1.1), making a transparent filling layer (2) on the inner facing surface of the outer shell (1.1) and connection of a three-dimensional object (5) onto inward facing surface of the filling layer (2). The three-dimensional object (5) is a three-dimensional figure.

Figure 2C:
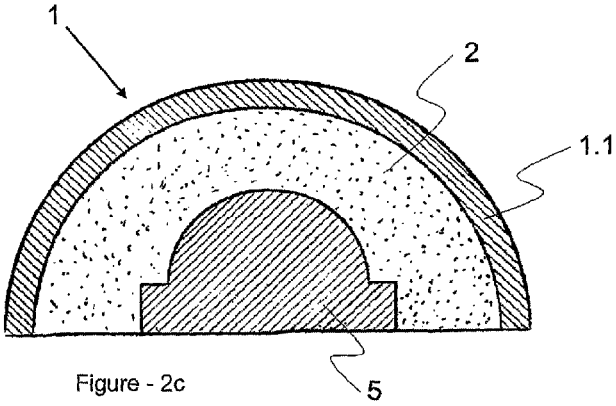
FIG. 2*c* is a sectional view of filling and three-dimensional object applied to the stone with space in the illustrative embodiment shown in FIG. 2*b*.
Figure 2D:
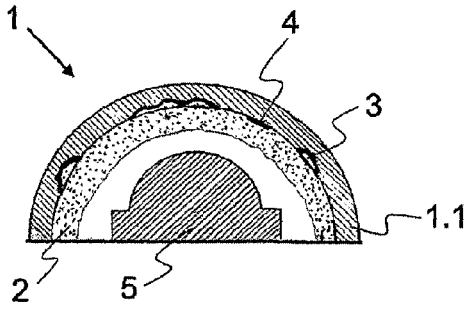
FIG. 2*d* is a sectional view of three-dimensional object applied to the stone with inside filling and processed in the illustrative embodiment shown in FIG. 1*c*.
Figure 2E:
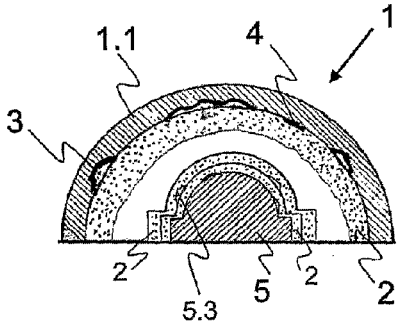
FIG. 2*e* is a sectional view of three-dimensional object with filling in outer surface and processed and connected to the stone with inside filling and processed in the illustrative embodiment shown in FIGS. 1*d* and 1*e*.
Figure 2F:
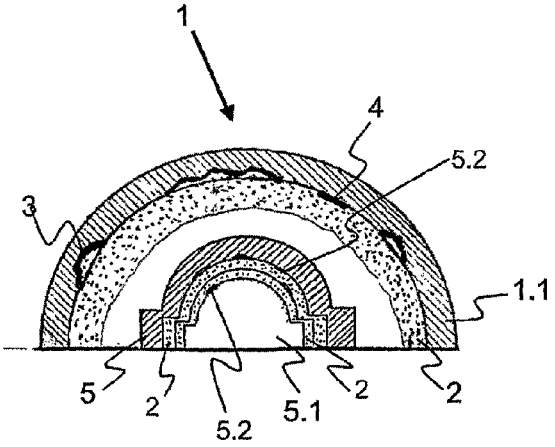
FIG. 2*f* is a sectional view of three-dimensional object with filling in inner surface and processed and connected to the stone with inside filling and processed in the illustrative embodiment shown in FIGS. 1*d* and 1*e*.

The three-dimensional object (5) shown in FIGS. 2*d*, 2*e* and 2*f* can complete the figures located in the stone (1) upon subjecting it to various processes. The process steps of the method shown in FIGS. 2*b* and 2*f* comprises: curving of the inner side of the three-dimensional object (5), forming space (5.1), making a filling inner figure (5.2) on the inner surface of the three-dimensional object (5), making the transparent filling layer (2) on the inner surface of the three-dimensional object (5) and connection of three-dimensional object (5) with processed inner part to the inner surface of the outer shell (1.1). When forming figure in the inner part of the three dimensional object (5), three-dimensional object (5) is designed from transparent material. The space (5.1) is reinforced by means of a filling material and lower surface of the stone (1) is covered. The filling applied to inner part of the space (5.1) can be provided in the convenient different colour and image designs as per the stone (1).

The three-dimensional object (5) shown in FIGS. 2*a* and 2*e* can complete the figures located in the stone (1) upon subjecting it to various processes. The sequence of process steps comprises: respectively making a filling outer figure (5.3) on outer surface of the three-dimensional object (5), making a transparent filling layer (2) on the outer surface of the three-dimensional object (5), connection of the three dimensional object (5) covered on the inner surface of the outer shell (1.1).

A method for forming a three-dimensional image inside a transparent stone (1) according to the above is characterized in that the filling layer (2) is a transparent material which can be processed to create depth.

The steps of the method shown in FIGS. 1*a*, 1*b*, 1*c* and 1*d*.

After the stone is provided with a space with a desired depth from lower part of the stone (FIG. 1*b*), relief is curved in the formed space onto inner walls. After painting the curved figures and the coating agent is applied, a new engraving is made as the second layer on this coating and then painted. A three-dimensional depth is provided to the architecture and engraving inside the stone by applying the processes several times.

The method shown in FIGS. 1*a*, 1*b*, 1*c* and 1*d* 5 comprises 3 steps.

At step 1, the jewelry is emptied by method of mechanical eroding at a convenient size and depth from lower part of the stone (FIGS. 1-*b*, 2*b*).

At step 2, a desired object (three-dimensional object (5)) is located inside the stone (FIGS. 2*d*, 2*e*, 2*f*).

At step 3, a transparent filling material (filling layer (2)) appropriate to the colour and features of the stone (1) is filled in the space remaining after location of object (three-dimensional object (5)) (FIG. 2*c*).

Process steps comprises: process of the stone (1), curving of the inside as convenient for the figure, painting the inside of the curving appropriate to the figure, and filling the curving in a manner supporting the curving.

The basic application in forming the three-dimensional image is to create original image of any figure. A negative figure is formed inside the stone (1). A negative eroding is made in the inner surface of the stone (1). Thus space is provided by eroding. The eroding is preferably performed by hand because of sensitivity. Thus the curving is realized. The limits of the inner volume are removed as much as possible and is used. The inside of the stone (1) is emptied in a manner the outer shell (1.1) remains.

In an illustrative application of the invention:

By means of curving from one edge inward of a precious and/or side precious stone (1) for instance, amethyst colour quartz, tourmalines, citrine, topaz aquamarines etc. by use of digging curving tools, the inside thereof is removed in a manner such that only one thin outer shell (1.1) remains on other edges. After completion of removing the inside by curving, any portrait, scene, religious symbol, word, devil eye symbol, shape, figure, pattern, picture etc. is drawn on the inner surfaces of the stone turned into a lantern by use of any paint and brushes. The painted picture forms the top coating of the work performed inside the stone. Then the inner surface of the outer shell (1.1) is coloured by dye. A desired image is provided to the inner part by engraving (3) or relief (4). The relief (4) can be provided by painting (FIG. 1*c*). Depth can be provided by applying filling layer (2) as required by the figure details. Filling layers (2) are applied in an order. Integrity is provided by performing engraving (3) on the filling layers (2) or colouring layers. Processing different images and painting (relief (4)) on each filling layer (2) married out. A gradual image is provided by means of creating image on each filling layer (2).

Figure 1D:
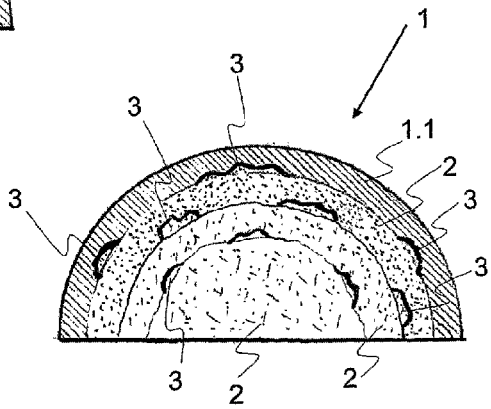
FIG. 1*d* is a section view of the form of stone comprising processed layers of the inner part in the illustrative embodiment shown in FIG. 1*c*.

The filling layers (2) connected to each other are displayed by various shading (FIG. 1*d*).

Among examples of figures made are birds flying over each other, flying butterflies, birds on a building and flying birds over a building, a home seen through an open window, imam at reading desk in a mosque, home view through an open window or dragon which can been imaged easily. It can be said that a kind of pictures over each other is made by means of the created images.

By filling the space remaining in the inner part of the stone (1) of which inner part is processed and shaped with layers, the process is completed. Support is provided by mine and a similar stone as three-dimensional object (5) (FIG. 2*b*).

The stone (1) to be processed can be transparent or opaque/matte colour as required by the design. The stone (1) material can be different mineral stone, glass. The process can be made to any types of stone (1). Curving technique depending on type of stone can be made by painting and filling technique.

In a different application, the figure can be located not in the form of a picture but as a processed material in the stone (1) such as a three-dimensional object (5) without curving. In other words, the figure can be located to lower base of the transparent stone (1) by means of a three-dimensional object (5). Or it can be supplemented with layer inside the stone (1) by processing apart of the figure on the three-dimensional object (5). The three-dimensional object (5) can also be a precious stone. The inner surface of the three-dimensional object (5) can also be processed.

Shaped stone (1) is inserted or fixed into jewelry and used. The products with coloured or non-coloured inside negative sculpture and decorated with stones formed according to the above description is attached to desired part of any jewelry and decorative belongings such as rings, bracelet, necklace, ear-rings, broche, cuff links by use of any fixing and adhering processes.

The invention cannot be limited to the illustrative embodiments given under this section. Alternative embodiments that can be developed by persons skilled in the related art on basis of basic factors covered under scope of protections indicated under claims shall mean violation of the invention.

The invention claimed is:

1. A method for forming a three-dimensional image inside a transparent stone comprising:

curving an inner side of the transparent stone so as to form a space and to leave an outer shell;

making at least one design onto an inward facing surface of said outer shell;

making at least one transparent filling layer onto said inward facing surface of said outer shell;

making at least one design onto an inward facing surface of said filling layer;

repeating the steps of making at least one transparent filling layer and making at least one design one under the other onto said inward facing surface of said filling layer;

connecting at least one three-dimensional object to said inward facing surface of said filling layer at a bottom thereof; and closing a lower part of the transparent stone.

2. The method for forming a three-dimensional image of claim 1, further comprising:

forming at least one engraving on said inward facing surface of said outer shell by curving.

3. The method for forming a three-dimensional image of claim 1, further comprising:

embossing at least one relief on said inward facing surface of said outer shell.

4. The method for forming a three-dimensional image of claim 1, further comprising:

forming a relief on said inward facing surface of said filling layer by curving.

5. The method for forming a three-dimensional image of claim 1, further comprising:

forming a relief on said inward facing surface of said filling layer by embossing.

6. The method for forming a three-dimensional image of claim 3, wherein said relief is a paint coating having a thickness and color.

7. The method for forming a three-dimensional image of claim 4, wherein said relief is a paint coating having a thickness and a color.

8. The method for forming a three-dimensional image of claim 5, wherein said relief is a paint coating having a thickness and a color.

* * * * *